US009986333B1

(12) United States Patent
Sun et al.

(10) Patent No.: US 9,986,333 B1
(45) Date of Patent: May 29, 2018

(54) FLUSH-FITTING SOUND OUTPUT DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Yu-Chun Sun, New Taipei (TW); Zhan-Sheng Lu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days. days.

(21) Appl. No.: 15/497,954

(22) Filed: Apr. 26, 2017

(30) Foreign Application Priority Data

Feb. 28, 2017 (CN) ..... 2017 1 0110438

(51) Int. Cl.

| | |
|---|---|
| ***H04R 9/08*** | (2006.01) |
| ***H04R 11/04*** | (2006.01) |
| ***H04R 3/00*** | (2006.01) |
| ***H04R 1/04*** | (2006.01) |
| ***H04R 1/28*** | (2006.01) |
| ***H04R 1/08*** | (2006.01) |
| ***H04R 1/40*** | (2006.01) |
| ***H04R 1/34*** | (2006.01) |

(52) U.S. Cl.
CPC ..... *H04R 3/005* (2013.01); *H04R 1/04* (2013.01); *H04R 1/08* (2013.01); *H04R 1/2876* (2013.01); *H04R 1/342* (2013.01); *H04R 1/406* (2013.01)

(58) Field of Classification Search
CPC . H04R 1/04; H04R 1/08; H04R 1/245; H04R 1/2876; H04R 1/324; H04R 1/342; H04R 1/406; H04R 3/00; H04R 3/005; H04R 3/04; H04R 3/10; H04R 2210/401; H04R 2210/403
USPC ..... 381/91, 92, 122, 111–117, 59, 95, 96, 381/336, 355, 356, 357, 360, 361
See application file for complete search history.

(56) References Cited

U.S. PATENT DOCUMENTS

| | | | | |
|---|---|---|---|---|
| 3,364,315 A * | 1/1968 | Gorike | H04R 1/04 181/164 |
| 4,268,912 A * | 5/1981 | Congdon | H04R 17/00 310/337 |
| 8,767,993 B2 * | 7/2014 | Kubin | H04R 1/406 381/345 |
| 2006/0285699 A1 * | 12/2006 | Fuqua | H04R 3/005 381/92 |

(Continued)

*Primary Examiner* — Xu Mei
(74) *Attorney, Agent, or Firm* — ScienBiziP, P.C.

(57) ABSTRACT

A sound output device which can be fitted flush to match shape and contour of a desired housing device includes an arc-shaped shell as the housing, a mainboard, at least one first sound output unit, at least one second output unit, and at least one conductive distance piece. The arc-shaped shell defines sound output holes. The first sound output unit is located on one side of the mainboard close to the at least two sound output holes. The at least one second output unit is located above the conductive distance piece on the side of the mainboard close to the sound output holes. The conductive distance piece elevates the at least one second sound output unit to the same level as that of the first sound output unit, or to some other level required for the particular shape of the arc-shaped shell.

10 Claims, 8 Drawing Sheets

(56) References Cited

U.S. PATENT DOCUMENTS

| | | | | |
|---|---|---|---|---|
| 2007/0201716 | A1* | 8/2007 | Wang | H04R 1/08<br>381/361 |
| 2018/0014099 | A1* | 1/2018 | Loeppert | H04R 1/04 |

* cited by examiner

FLUSH-FITTING SOUND OUTPUT DEVICE

BACKGROUND

An electronic device which has six or seven microphones or loudspeakers has a surface appearance parallel to a circuit board. Such electronic devices cannot have a smooth and curved appearance. Therefore, the design of the top appearance for such electronic devices is limited, and aesthetic appeal is thus also limited.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
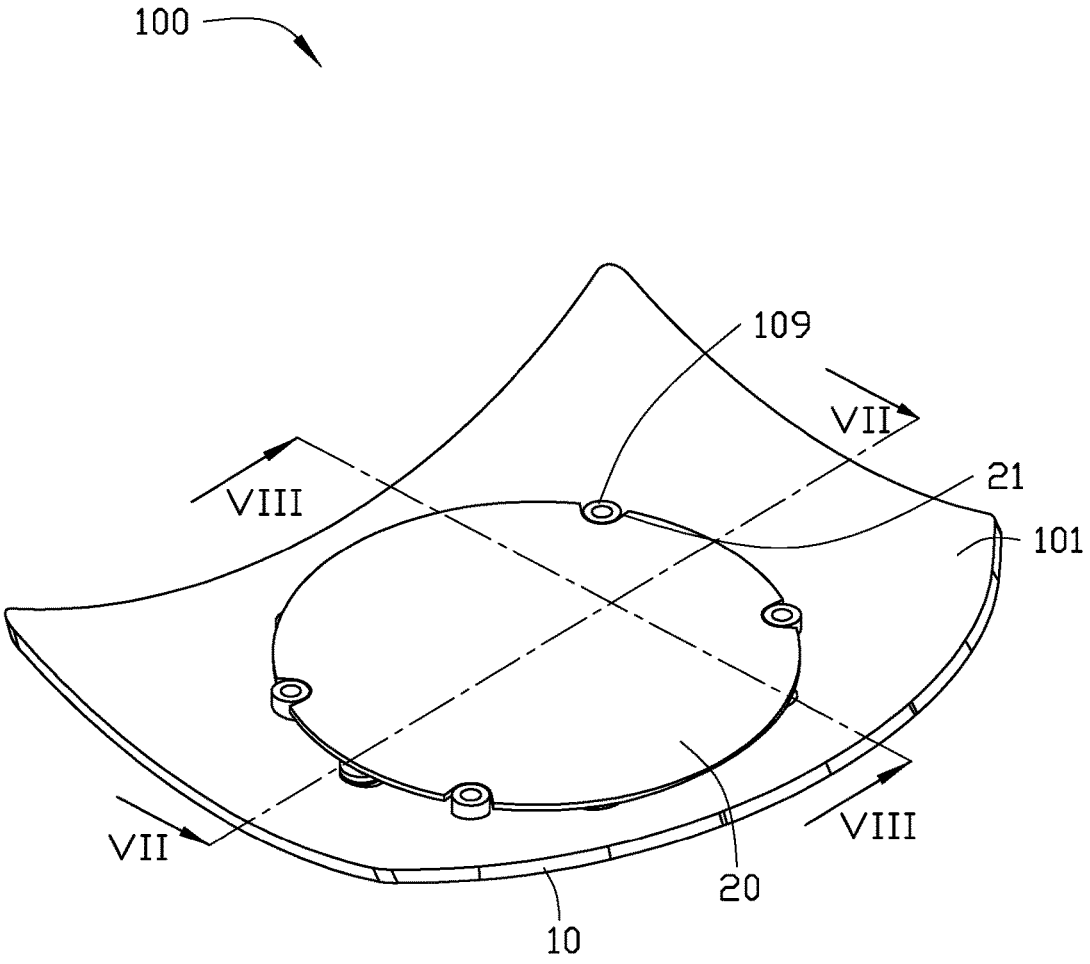
FIG. 1 is a schematic diagram of an exemplary embodiment of a sound output device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale, and the proportions of certain parts have been exaggerated to illustrate details and features of the present disclosure better.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

Figure 2:
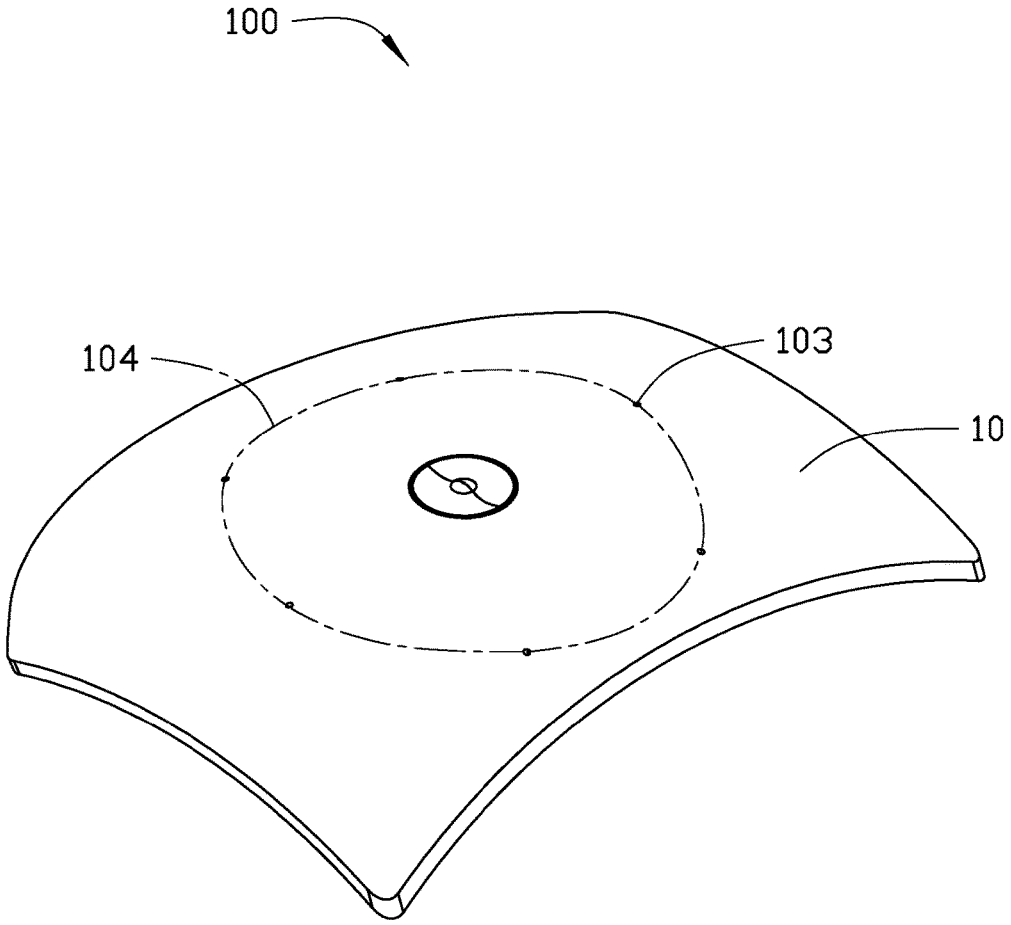
FIG. 2 is similar to FIG. 1 but viewed from another aspect.
Figure 3:
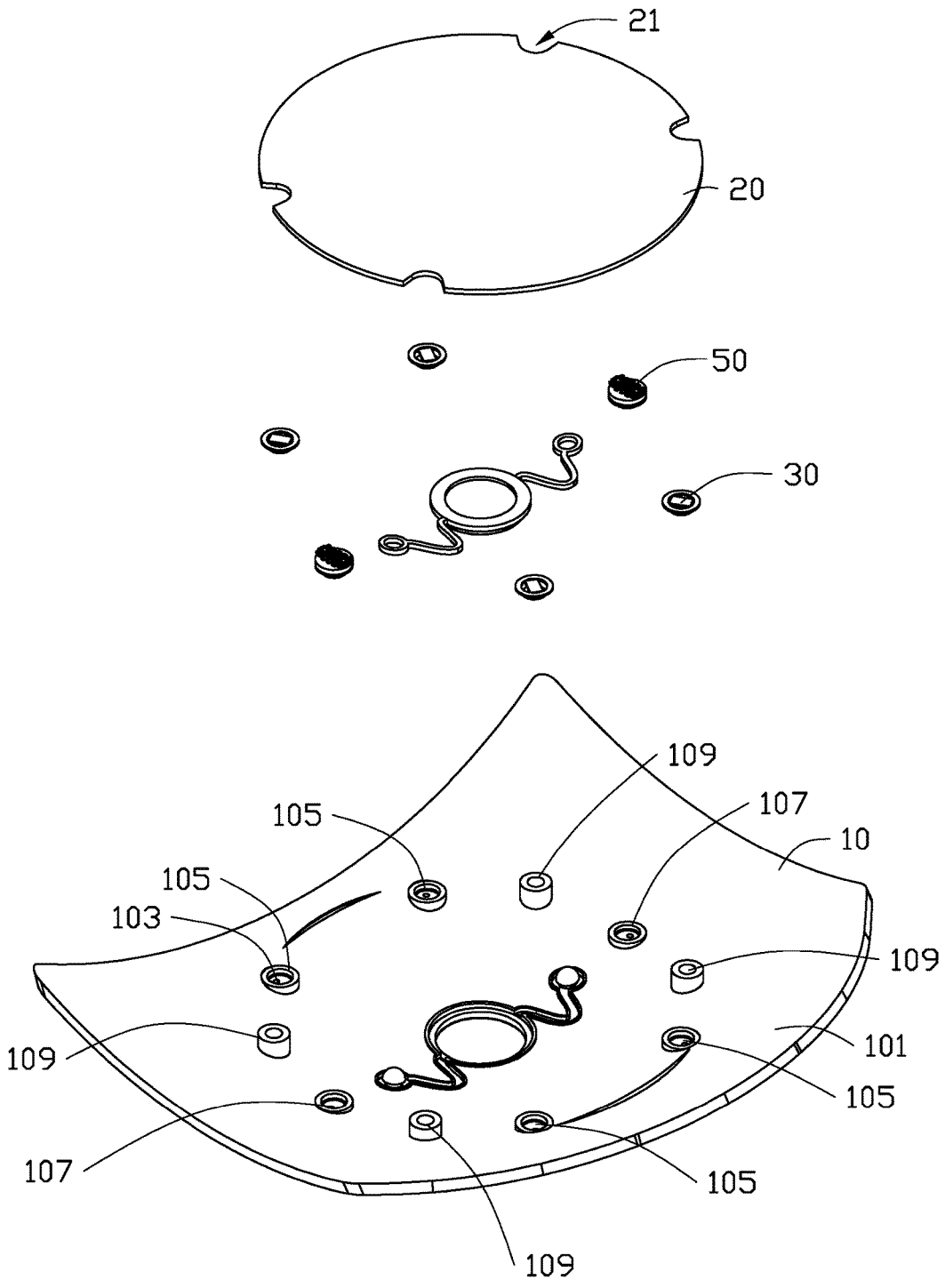
FIG. 3 is an exploded view of the device of FIG. 1.
Figure 4:
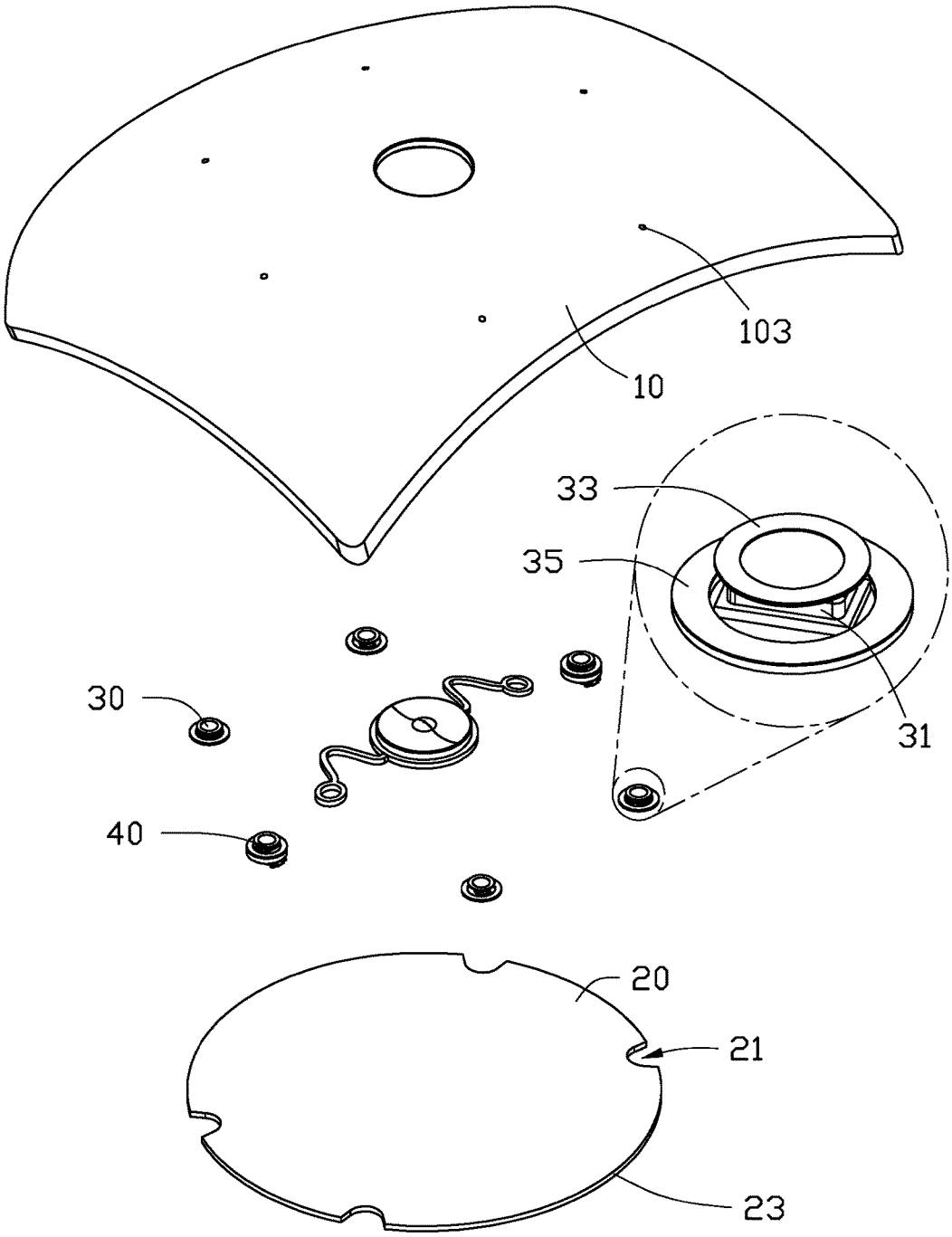
FIG. 4 is another exploded view of the device of FIG. 1.

FIGS. 1 and 2 show an exemplary embodiment of a sound output device 100. The sound output device 100 can be configured to output audio, for example, a speaking voice for a robot. In at least one embodiment, the sound output device 100 can be configured to output sound for other suitable electronic device. As shown in FIGS. 3 and 4, the sound output device 100 can include an arc-shaped housing 10, a mainboard 20, at least one first sound output unit 30, at least one second sound output unit 40 and at least one conductive distance piece 50. The arc-shaped housing 10 can be one portion of an arc-shaped shell of the robot. The arc-shaped housing 10 can have an inner surface 101. The arc-shaped housing 10 can define at least two sound output holes 103 along a circle periphery 104 of the inner surface 101. In detail, in this embodiment, the number of sound output holes 103 is six. Optionally, the arc-shaped housing 10 can further define at least one first mount groove 105 and at least one second mount groove 107 at regular intervals along the circle periphery 104. Therein, each sound output hole 103 can be defined on the bottom of one of the at least one first mount groove 105 or one of the at least one second mount groove 107. In one embodiment, the number of first mount grooves 105 is four, and the number of second mount grooves 107 is two. The arc-shaped housing 10 can include at least three engaging posts 109 at regular intervals along the circle periphery 104 at the inner surface 101 thereon. Therein, the number of engaging posts 109 is four.

The mainboard 20 can be located on the inner surface 101 of the arc-shaped housing 10. In this embodiment, the mainboard 20 can be circular and planar. The diameter of the mainboard 20 can be 80 mm. The mainboard 20 can further define at least three engage openings 21 along a periphery 23 (see FIG. 4) thereof. Each engaging post 109 can be engaged in one engage opening 21. The mainboard 20 can be thus engaged in the inner surface 101 of the arc-shaped housing 10. In this embodiment, the number of engage openings 21 is four.

The at least one first sound output unit 30 and the at least one second sound output unit 40 are located on the mainboard 20. In this embodiment, the at least one first sound output unit 30 and the at least one second sound output unit 40 are located on the periphery 23 of the mainboard 20. In this embodiment, the number of first sound output units 30 is four, and the number of second sound output units 40 is two. The four first sound output units 30 and the two second sound output units 40 are arranged as two first sound output units 30 and one second sound output unit 40 alternately on the periphery 23 of the mainboard 20. In detail, the at least one first sound output unit 30 is arranged on the mainboard 20 directly. Each of the first sound output units 30 is accommodated in one first mount groove 105. Therein, each first sound output unit 30 can include a first microphone 31. In this embodiment, a diametric distance between two first microphones 31 is 73 mm. In this embodiment, the first microphone 31 is located on the mainboard 20 directly. Each first sound output unit 30 can further include a first dust gauze 33 and a first sound-isolating damper 35. The first dust gauze 33 can be located on an upper surface of the first microphone 31. The first sound-isolating damper 35 can be partly located between the first dust gauze 33 and the first microphone 31, and partly located around a periphery of the first microphone 31.

Figure 5:
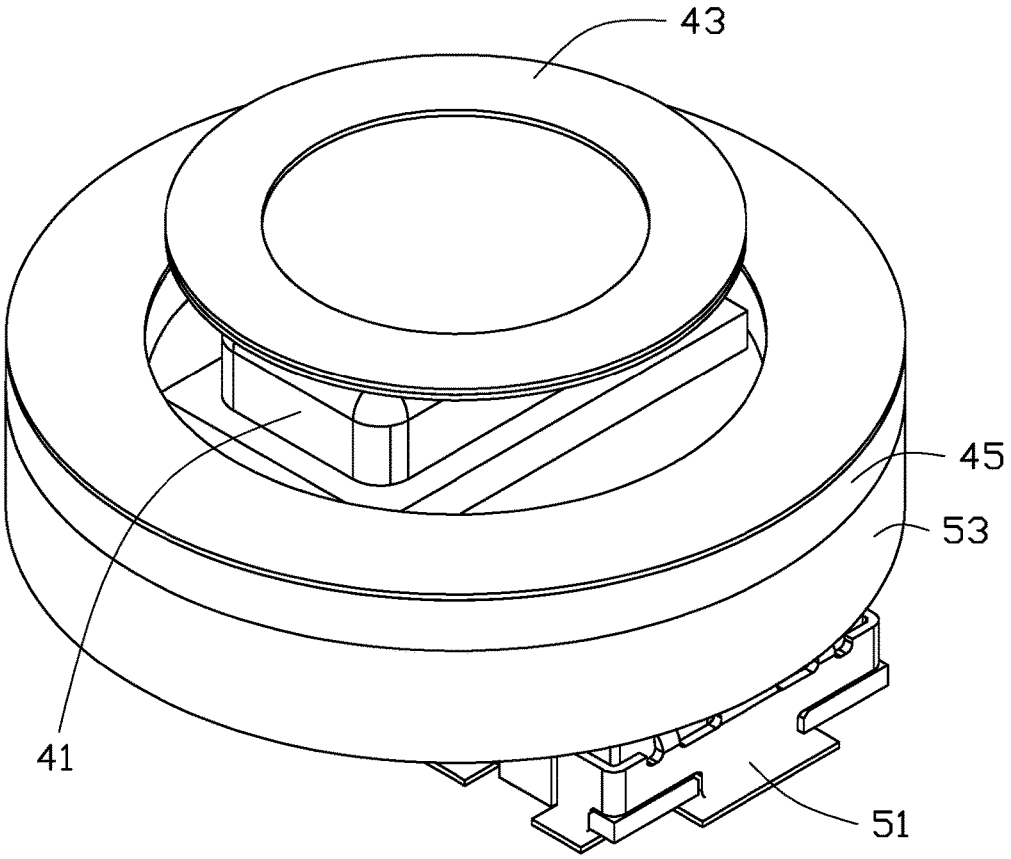
FIG. 5 is an enlarged view of some components of the device of FIG. 1.
Figure 6:
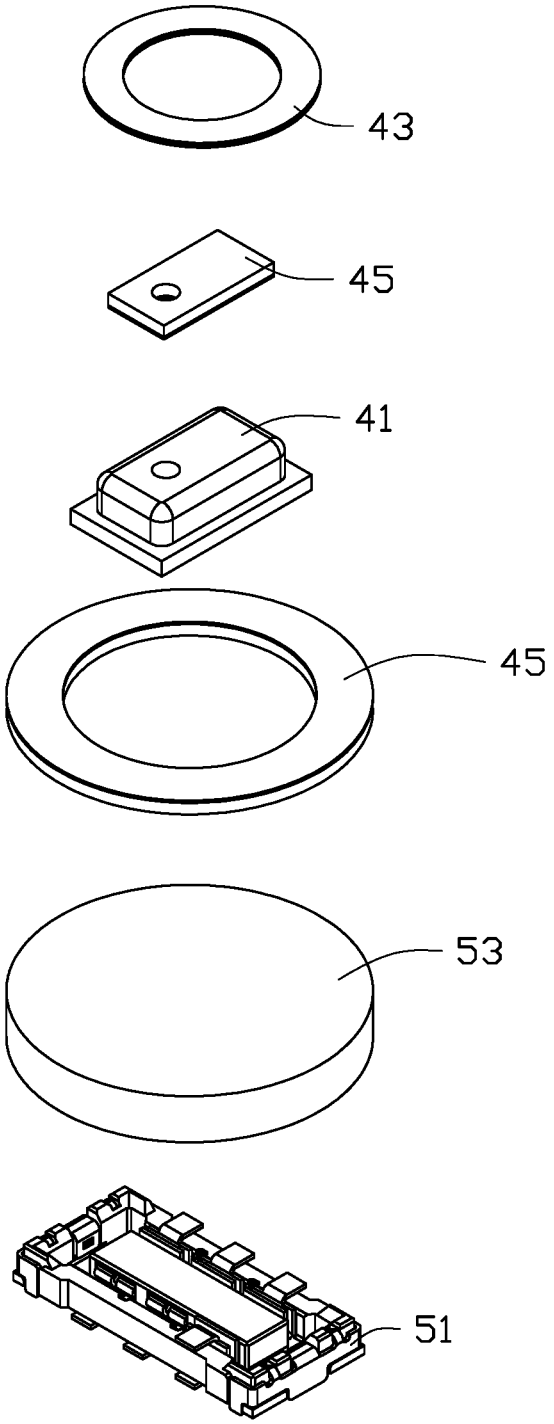
FIG. 6 is an exploded view of the device of FIG. 4.

As shown in FIGS. 5 and 6, a first sound output unit 30 and a second sound output unit 40 can be located on the mainboard 20 directly at first and second distances respectively. A first distance is a distance between the first sound output unit 30 and one sound output hole 103, and a second distance is a distance between the second sound output unit 40 and one sound output hole 103. The second distance is greater than the first distance. Therefore, the second sound output unit 40 needs to be elevated by the at least one conductive distance piece 50 located between the second sound output unit 40 and the mainboard 20. Each second sound output unit 40 can be located on one second mount hole 107. Each second sound output unit 40 can include a second microphone 41. In an embodiment, a diametric distance between two second microphones 41 is 73 mm. Each second sound output unit 40 can further include a second dust gauze 43 and a second sound-isolating damper 45. The second dust gauze 43 can be located on an upper surface of the second microphone 41. The second sound-isolating damper 45 can be partly located between the second dust gauze 43 and the second microphone 41, and partly located around a periphery of the second microphone 41.

The conductive distance piece 50 can be electrically coupled between the second microphone 41 and the mainboard 20. The conductive distance piece 50 elevates the at least one second sound output unit 40, such that the first distance and the second distance become equal. In this embodiment, the number of conductive distance pieces 50 can be two. Each conductive distance piece 50 can include a connector 51 and a printed circuit board 53. The connector 51 couples the printed circuit board 53 to the mainboard 20. In detail, the connector 51 can be BTB 6 pin connector. The height of the connector 51 is 1.1 mm. The printed circuit board 53 can be plate-like. The connector 51 and the printed circuit board 53 cooperatively elevate the second microphone 41 for 1.9 mm, such that the first distance and the second distance are equal.

Figure 7:
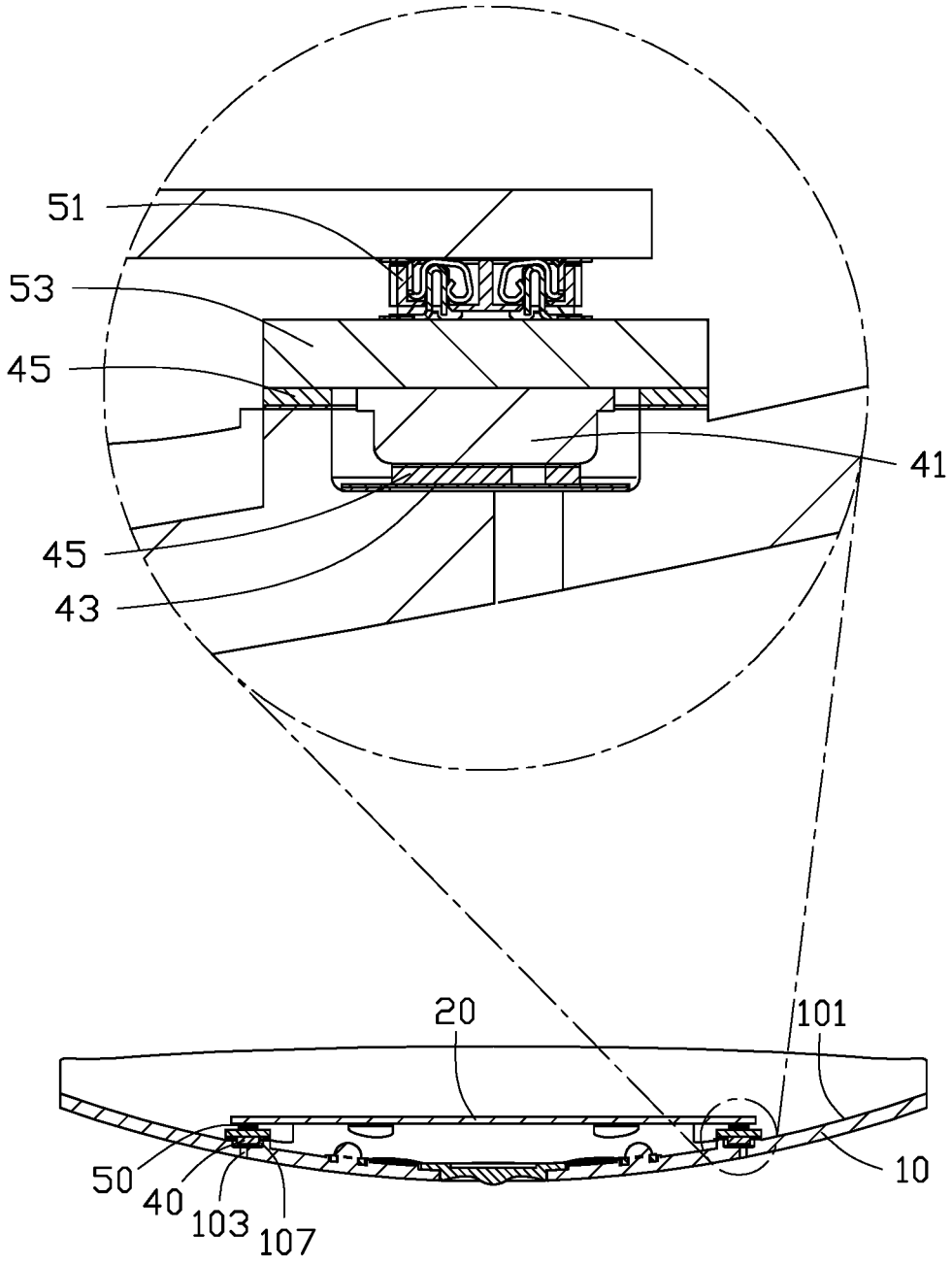
FIG. 7 is a cross-sectional view taken along line VII-VII of FIG. 1.
Figure 8:
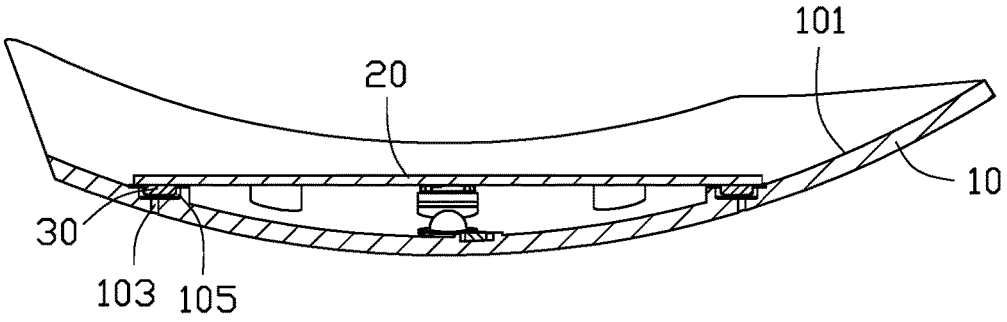
FIG. 8 is a cross-sectional view taken along line VIII-VIII of FIG. 1.

As shown in FIGS. 7 and 8, when in assembly, the at least one first sound output unit 30 is mounted on the mainboard 20, and the at least one second sound output unit 40 is mounted on the mainboard 20 at top of the at least one conductive distance piece 50. The first sound output unit 30 can be further mounted in the first mount groove 105. The second sound output unit 40 can be further mounted on the second mount groove 107. The first microphone 31 and the second microphone 41 face sound output hole 103, and the first distance being equal to the second distance, the surface appearance for such electronic devices can be designed in an unrestricted manner and not limited to the shape of the mainboard 20.

In at least one embodiment, the number of sound output holes 103 can be but is not limited to four.

In at least one embodiment, the first mount groove 105 and the second mount groove 107 can be omitted.

In at least one embodiment, the number of engaging posts 109 can be, but is not limited to, four.

In at least one embodiment, the shape of the mainboard 20 can be, but is not limited to, round.

In at least one embodiment, the number of engage openings 21 can be, but is not limited to, four.

In at least one embodiment, the type of the connector 51 can be but, is not limited to, BTB 6-pin connector.

In at least one embodiment, the size of the mainboard 20, the connector 51, and the printed circuit board 53 may be according to need.

The exemplary embodiments shown and described above are only examples. Many details are often found in the art such as the features of the flush-fitting sound output device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will, therefore, be appreciated that the exemplary embodiments described above may be modified within the scope of the claims.

What is claimed is:

1. A sound output device comprising an arc-shaped housing, the arc-shaped housing defining at least two sound output holes;

a mainboard, at least one conductive distance piece;

at least one first sound output unit located on one side of the mainboard close to the at least two sound output holes; and at least one second output unit located on the side of the mainboard close to the at least two sound output holes through the at least one conductive distance piece;

wherein, the at least one conductive distance piece causes that a distance between one of the at least one first sound output unit and one corresponding sound output hole is equal to a distance between one of the at least one second sound output unit and one corresponding sound output hole.

2. The sound output device of claim 1, wherein, each first sound output unit comprises a first microphone, and each first microphone is located on the mainboard.

3. The sound output device of claim 2, wherein, each first sound output unit further comprises a first dust gauze and a first sound-isolating damper; each first dust gauze is located on one corresponding first microphone, and each first sound-isolating damper is partly located between one corresponding first dust gauze and the corresponding first microphone and partly located around the corresponding first microphone.

4. The sound output device of claim 1, wherein each second sound output unit comprises a second microphone; each conductive distance piece comprises a connector and a printed circuit board; each connector couples one corresponding printed circuit board to the mainboard, and each second microphone is located on the corresponding printed circuit board.

5. The sound output device of claim 4, wherein, each second output device further comprises a second dust gauze and a second sound-isolating damper; each second dust gauze is located on one corresponding second microphone, and each second sound-isolating damper is partly located between one corresponding second dust gauze and the corresponding second microphone, and partly located around the corresponding second microphone.

6. The sound output device of claim 1, wherein, the mainboard is a circular plane; the mainboard defines a periphery; the at least one first sound output unit and the at least one second sound output unit are arranged on the periphery of the mainboard.

7. The sound output device of claim 6, wherein, the mainboard defines at least three engage openings along the peripheral thereof; the arc-shaped housing comprises at least three engaging posts at regular intervals; each engaging post is engaged in one corresponding engage opening, and the mainboard is thus engaged with the arc-shaped housing.

8. The sound output device of claim 1, wherein, the mainboard defines a periphery; the at least one first sound output unit comprises four first sound output units; the at least one second sound output unit comprises two second sound output units; the four first sound output units and the two second sound output units are arranged as two first sound output units and one second sound output unit on the periphery alternately.

9. The sound output device of claim 1, wherein, the arc-shaped housing defines at least one first mount groove and at least one second mount groove; each sound output hole is located in one of the at least one first mount groove or one of the at least one second mount groove; each first sound output unit is located on one of the at least one first mount groove; and each second sound output is located on one of the at least one second mount groove.

10. The sound output device of claim 9, wherein, the at least one first mount groove comprises four first mount grooves; the at least one second mount groove comprises two second mount grooves; the at least one first sound output unit comprises four first sound output units; the at least one second sound output unit comprises two second sound output units; the four first sound output units are mounted in the four first mount grooves respectively; and the two second sound output units are mounted in the two second mount grooves respectively.

* * * * *